US012504214B2

(12) United States Patent
Li et al.

(10) Patent No.: US 12,504,214 B2
(45) Date of Patent: Dec. 23, 2025

(54) REFRIGERATOR

(71) Applicants: QINGDAO HAIER REFRIGERATOR CO., LTD., Shandong (CN); HAIER SMART HOME CO., LTD., Shandong (CN)

(72) Inventors: Jiaming Li, Qingdao (CN); Hao Zhang, Qingdao (CN); Peng Lyu, Qingdao (CN); Zhanpeng Cui, Qingdao (CN)

(73) Assignees: QINGDAO HAIER REFRIGERATOR CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 176 days.

(21) Appl. No.: 18/245,269

(22) PCT Filed: Aug. 31, 2021

(86) PCT No.: PCT/CN2021/115632
§ 371 (c)(1),
(2) Date: Mar. 14, 2023

(87) PCT Pub. No.: WO2022/057612
PCT Pub. Date: Mar. 24, 2022

(65) Prior Publication Data

US 2023/0392852 A1 Dec. 7, 2023

(30) Foreign Application Priority Data

Sep. 15, 2020 (CN) ..... 202010970777.6

(51) Int. Cl.
*F25D 17/04* (2006.01)
*F25D 17/06* (2006.01)

(52) U.S. Cl.
CPC ..... *F25D 17/045* (2013.01); *F25D 17/062* (2013.01); *F25D 2317/062* (2013.01); *F25D 2317/066* (2013.01)

(58) Field of Classification Search
CPC .. F25D 17/045; F25D 23/02; F25D 2317/066; F25D 2317/062; F25D 17/062
See application file for complete search history.

(56) References Cited

U.S. PATENT DOCUMENTS 9,857,122 B2 * 1/2018 Im ..... F25D 17/067
2007/0130986 A1 * 6/2007 Kinser ..... A47F 3/0443 62/255

(Continued)

FOREIGN PATENT DOCUMENTS

CN 102494480 A 6/2012
CN 203364538 U 12/2013

(Continued)

OTHER PUBLICATIONS

Translated_Jing (Year: 2020).*

(Continued)

*Primary Examiner* — Jerry-Daryl Fletcher
*Assistant Examiner* — Samba Gaye
(74) *Attorney, Agent, or Firm* — troutman pepper locke; Tim Tingkang Xia, Esq.

(57) ABSTRACT

A refrigerator comprises: a refrigerator body having an open front side to define a first chamber; and a door body used to open or close the first chamber and defining a second chamber. The door body further defines a square annular air duct surrounding an outer side of the second chamber. The air duct comprises an air inlet section, two air supply sections and an air outlet section which are respectively located at an upper side, two transverse sides and a lower side of the second chamber. The air inlet section has an air (Continued)

inlet for intake of cold air. Each air supply section has an air supply portion for supplying the cold air to the second chamber. The air outlet section has an air outlet for discharging the remaining cold air in the air duct. The temperature in the chamber defined by the door body can be independently controlled.

8 Claims, 7 Drawing Sheets

(56) References Cited

U.S. PATENT DOCUMENTS

| | | | | |
|---|---|---|---|---|
| 2010/0251743 | A1 | 10/2010 | Lee et al. | |
| 2011/0146331 | A1 | 6/2011 | Moon et al. | |
| 2015/0276301 | A1* | 10/2015 | Oh | F25D 23/025 312/405 |
| 2016/0238302 | A1* | 8/2016 | Yang | F25D 23/062 |
| 2017/0122649 | A1 | 5/2017 | Im et al. | |
| 2018/0328641 | A1* | 11/2018 | Lee | F25D 23/04 |
| 2019/0360737 | A1* | 11/2019 | Lv | F25C 5/22 |
| 2020/0284493 | A1* | 9/2020 | Lee | F25D 17/08 |

FOREIGN PATENT DOCUMENTS

| | | | | | |
|---|---|---|---|---|---|
| CN | 105444489 | A | | 3/2016 | |
| CN | 210035994 | U | * | 2/2020 | |
| CN | 212378329 | U | | 1/2021 | |
| EP | 4206572 | A1 | | 7/2023 | |
| KR | 2005077556 | A | * | 8/2005 | F25C 5/22 |
| KR | 2007055904 | A | * | 5/2007 | |
| KR | 20090059660 | A | | 6/2009 | |
| KR | 20160045316 | A | | 4/2016 | |
| WO | WO 2009/072773 | A2 | | 6/2009 | |

OTHER PUBLICATIONS

Translated_Lee (Year: 2005).*
Translated_Ryu (Year: 2007).*
International Search Report and Written Opinion for PCT/CN2021/115632 (ISA/CN) mailed Nov. 4, 2021 w/English translation (11 pages).
1st Examination Report for Australia Patent Application No. 2021344298 dated Jan. 22, 2024 (3 pages).
1st Office Action for European Patent Application No. 21868439.7 dated Jan. 10, 2024 (8 pages).
Supplementary European Search Report for European Patent Application No. 21868493.7 dated Dec. 15, 2023 (4 pages).

* cited by examiner

REFRIGERATOR

CROSS-REFERENCE TO RELATED APPLICATIONS

The present application is a national phase entry of International Application No. PCT/CN2021/115632, filed Aug. 31, 2021, which claims priority to Chinese Application No. 202010970777.6, filed Sep. 15, 2020, which are each incorporated herein by reference in its entirety.

FIELD OF THE INVENTION

The present invention relates to the technical field of refrigeration and freezing, and in particular to a refrigerator.

BACKGROUND OF THE INVENTION

With the advancement of technology and the improvement of people's living standards, users have higher and higher requirements for refrigerators. The traditional refrigerators with only a refrigerating room, a freezing room and a temperature-variable room can no longer meet users' diverse needs for storage space.

In recent years, a composite door body technology has emerged in the field of refrigerators. As is well-known to all, a traditional refrigerator door body is used to open and close a refrigeration chamber of a refrigerator body. At most, a bottle holder is disposed at an inner lining of the refrigerator door body for placing bottled articles. As for a refrigerator with the composite door body, the structure and functions of the door body are improved, which makes the door body include a main door and a secondary door, and enables the main door to be used for opening and closing the refrigeration chamber. In addition, the main door defines a door body chamber with an open front side, and the secondary door is used to open and close the door body chamber. The secondary door remains closed during rotation of the main door. The door body chamber can be used for placement of stored articles, and only the secondary door needs to be opened when taking and placing the stored articles, without opening the main door. It not only makes the operation more convenient and faster, but also avoids excessive cold energy loss caused by frequent opening of the main door.

However, the refrigerator with the composite door also has many defects. For example, the space of the door body chamber is too small, the temperature is not easy to control, the storage conditions of the door body chamber are similar to those of the refrigerating room, or even the door body chamber is in complete communication with the refrigerating room to become a part of the refrigerating room. These problems will have a negative impact on user experience and hinder the further development of the composite door technology.

BRIEF DESCRIPTION OF THE INVENTION

An object of the present invention is to solve at least one of the above-mentioned defects existing in the prior art, and to provide a refrigerator in which the temperature of a chamber of a door body is independent of the temperature of a chamber of a refrigerator body.

Another object of the present invention is to make the temperature distribution throughout the chamber of the door body more uniform.

In particular, the present invention provides a refrigerator, including:

a refrigerator body, a front side of which is open to define a first chamber; and a door body, used for opening and closing the first chamber and defining a second chamber, where the door body further defines a square annular air duct surrounding an outer side of the second chamber, and the air duct includes an air inlet section, two air supply sections and an air outlet section which are respectively located at an upper side, two transverse sides and a lower side of the second chamber; and the air inlet section has an air inlet for intake of cold air, each air supply section has an air supply portion for conveying the cold air to the second chamber, and the air outlet section has an air outlet for discharging the remaining cold air in the air duct.

Optionally, the second chamber is divided into a plurality of sub-chambers, and each of the sub-chambers is matched with at least one of the air supply portions.

Optionally, each of the sub-chambers is matched with the air supply portions on the two air supply sections.

Optionally, each of the air supply portions includes an electric damper so as to adjust the flow rate of cold air entering the second chamber from the air supply sections.

Optionally, the door body is configured such that both the air inlet and the air outlet are located in the first chamber when the door body is in a closed state, so as to allow the air duct to introduce the cold air in the first chamber and return air to the first chamber.

Optionally, an air return inlet is reserved in a bottom of the second chamber; and when the door body is in the closed state, the air return inlet is located in the first chamber to allow the second chamber to return air to the first chamber.

Optionally, an air inlet fan is disposed in the air inlet section to suck the cold air into the air duct through the air inlet; and both the air inlet and the air inlet fan are located at a transverse central position of the air inlet section, so that the air inlet fan blows uniformly to both transverse sides of the air inlet section.

Optionally, an exhaust fan is disposed at a transverse central position of the air outlet section, so as to exhaust air to the air outlet.

Optionally, the door body includes: an inner liner, defining the second chamber and the air inlet section; and an enclosure cover, which surrounds and covers the inner liner at a circumferential outer side of the inner liner, so as to define the two air supply sections and the air outlet section together with an outer wall of the inner liner; and a top of the enclosure cover is provided with an air inlet grille opposite to the air inlet, and the air outlet is provided at a bottom thereof.

Optionally, the door body includes a main door and a secondary door, where the main door is used for defining the second chamber and the air duct, and the secondary door is used for opening and closing the second chamber.

According to the refrigerator provided by the present invention, the second chamber defined by the door body is not simply and directly communicated with the first chamber defined by the refrigerator body for uncontrolled cold and heat exchange, but is specially designed with an air duct for cooling the second chamber. As a result, the refrigerator can adjust the cryogenic temperature of the second chamber by adjusting the supply of cold air from the air duct to the second chamber, thus making the second chamber truly an independent storage space independent of the first chamber, enriching users' choices and improving the user experience.

Further, according to the refrigerator provided by the present invention, the air duct is in a square ring shape surrounding the outer side of the second chamber, and the air supply sections, located at the two transverse sides of the second chamber, of the air duct are used to supply air to the second chamber. Since the air supply sections span the entire height range of the second chamber, a designer can choose to dispose a plurality of air supply portions at multiple height positions of the air supply sections to meet the cold air demand at various height positions of the second chamber, and the temperature distribution throughout the second chamber is accordingly more uniform. Moreover, the cold air of each air supply portion comes directly from the air duct, so that the coverage of the air supply portions is directly cooled by the cold air of the air duct, and the refrigeration efficiency is thus higher.

Further, according to the refrigerator provided by the present invention, the second chamber is divided into the plurality of sub-chambers, and each of the sub-chambers is matched with the independent air supply portions, so that each sub-chamber is independently supplied with the cold air, and the temperatures of all the sub-chambers can be independently adjusted to form storage environments which are different from each other. A user can individually adjust the temperature of each sub-chamber according to the special requirement for the temperature of articles stored in the sub-chamber, so that a best storage state can be achieved.

The above and other objectives, advantages, and features of the present invention will be better understood by those skilled in the art according to the following detailed description of specific embodiments of the present invention in conjunction with the accompanying drawings.

BRIEF DESCRIPTION OF THE DRAWINGS

In the following part, some specific embodiments of the present invention will be described in detail in an exemplary rather than limited manner with reference to the accompanying drawings. The same reference numerals in the accompanying drawings indicate the same or similar components or parts. Those skilled in the art should understand that these accompanying drawings are not necessarily drawn to scale. In figures.

DETAILED DESCRIPTION

A refrigerator according to an embodiment of the present invention will be described below with reference to FIGS. 1 to 7. The orientations or positional relationships indicated by 'front', 'rear', 'upper', 'lower', 'top', 'bottom', 'inside', 'outside', 'transverse', etc. are based on the orientations or positional relationships shown in the accompanying drawings, only for the convenience of describing the present invention and simplifying the description, rather than indicating or implying that a device or an element referred to must has a particular orientation, and be constructed and operated in a particular orientation, and therefore cannot be construed as a limitation of the present invention.

Figure 1:
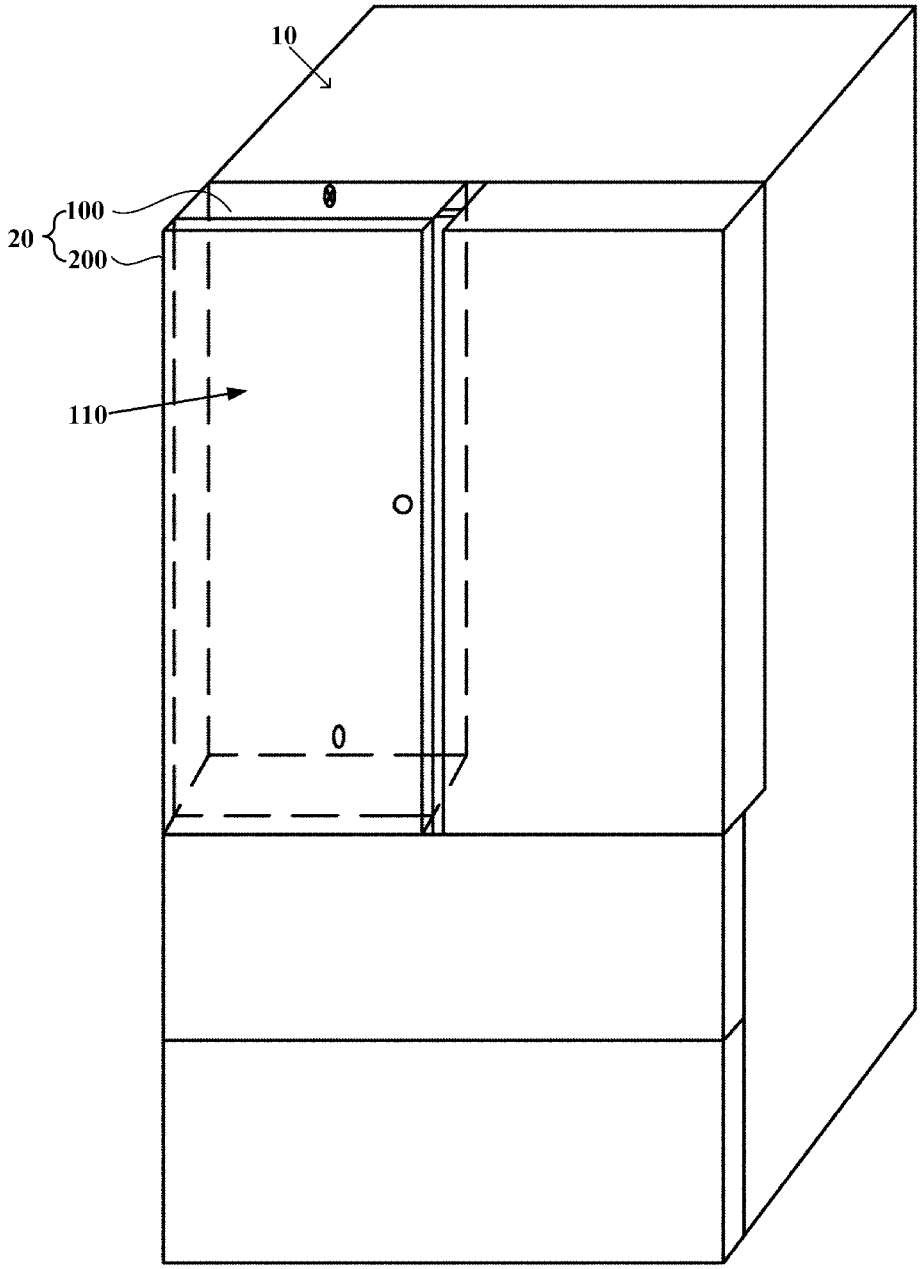
FIG. 1 is a principle schematic diagram of a refrigerator according to an embodiment of the present invention.
Figure 2:
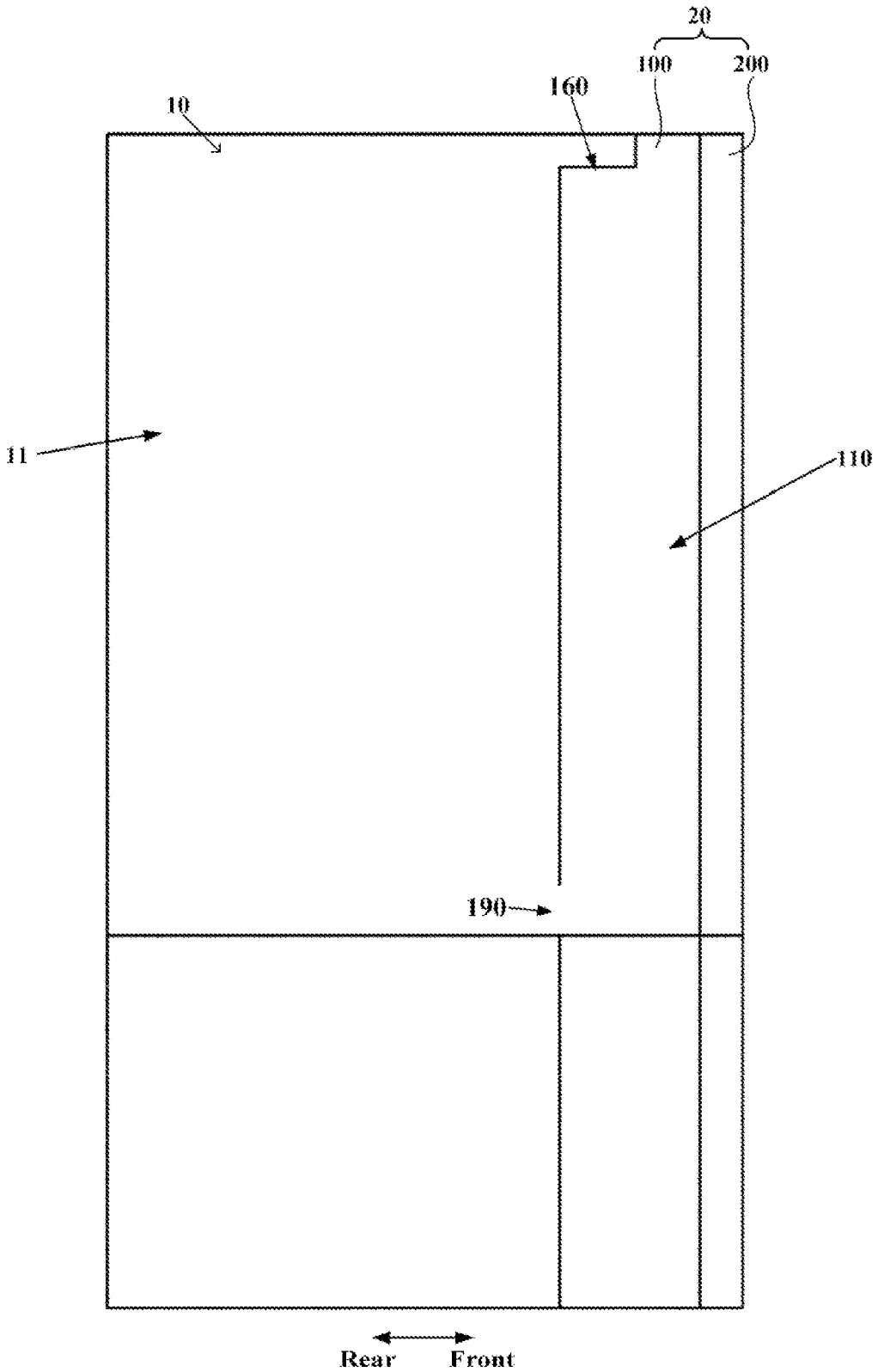
FIG. 2 is another principle schematic diagram of a refrigerator according to an embodiment of the present invention.
Figure 3:
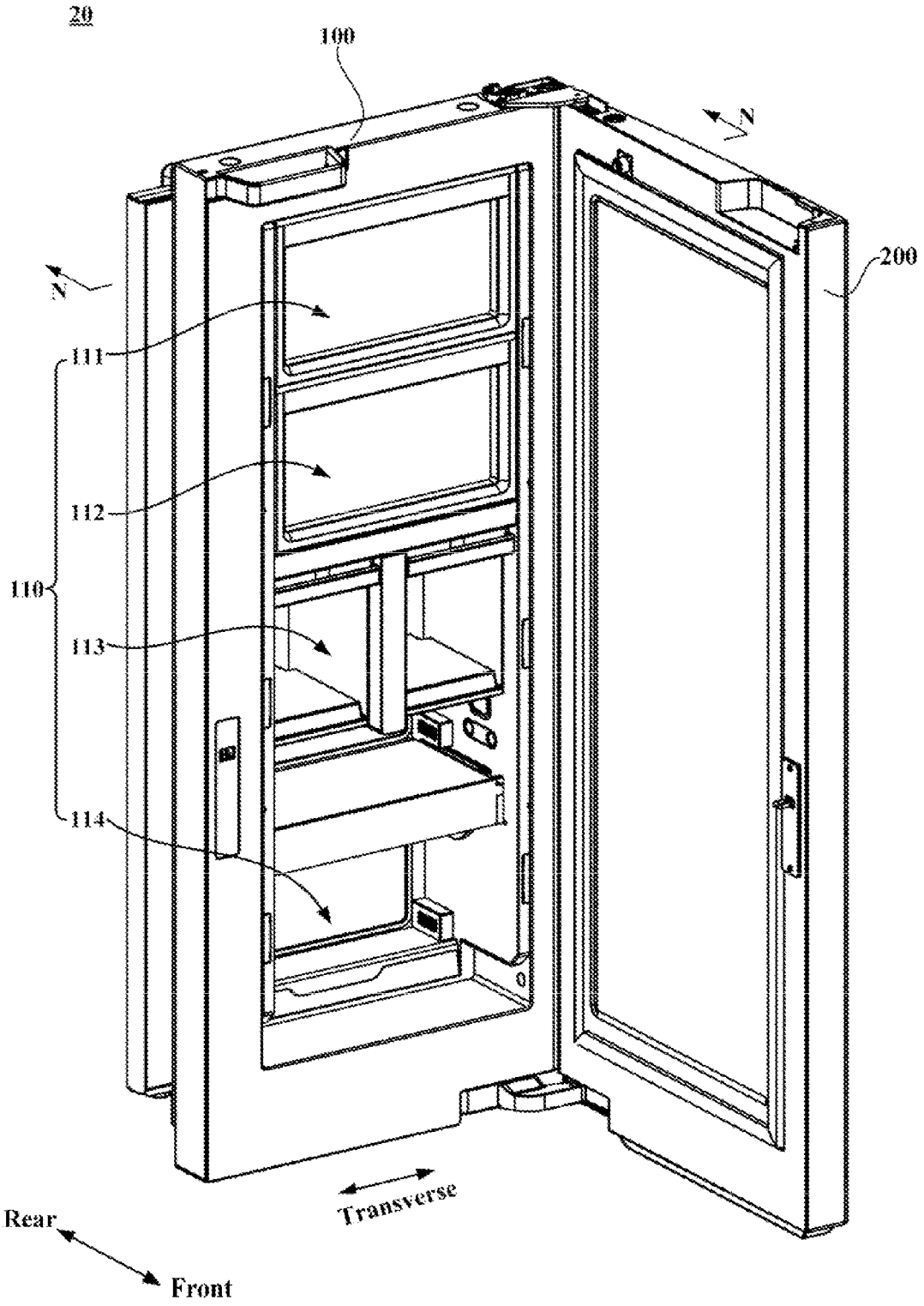
FIG. 3 is a schematic diagram of a structure of a door body in a refrigerator according to an embodiment of the present invention.
Figure 4:
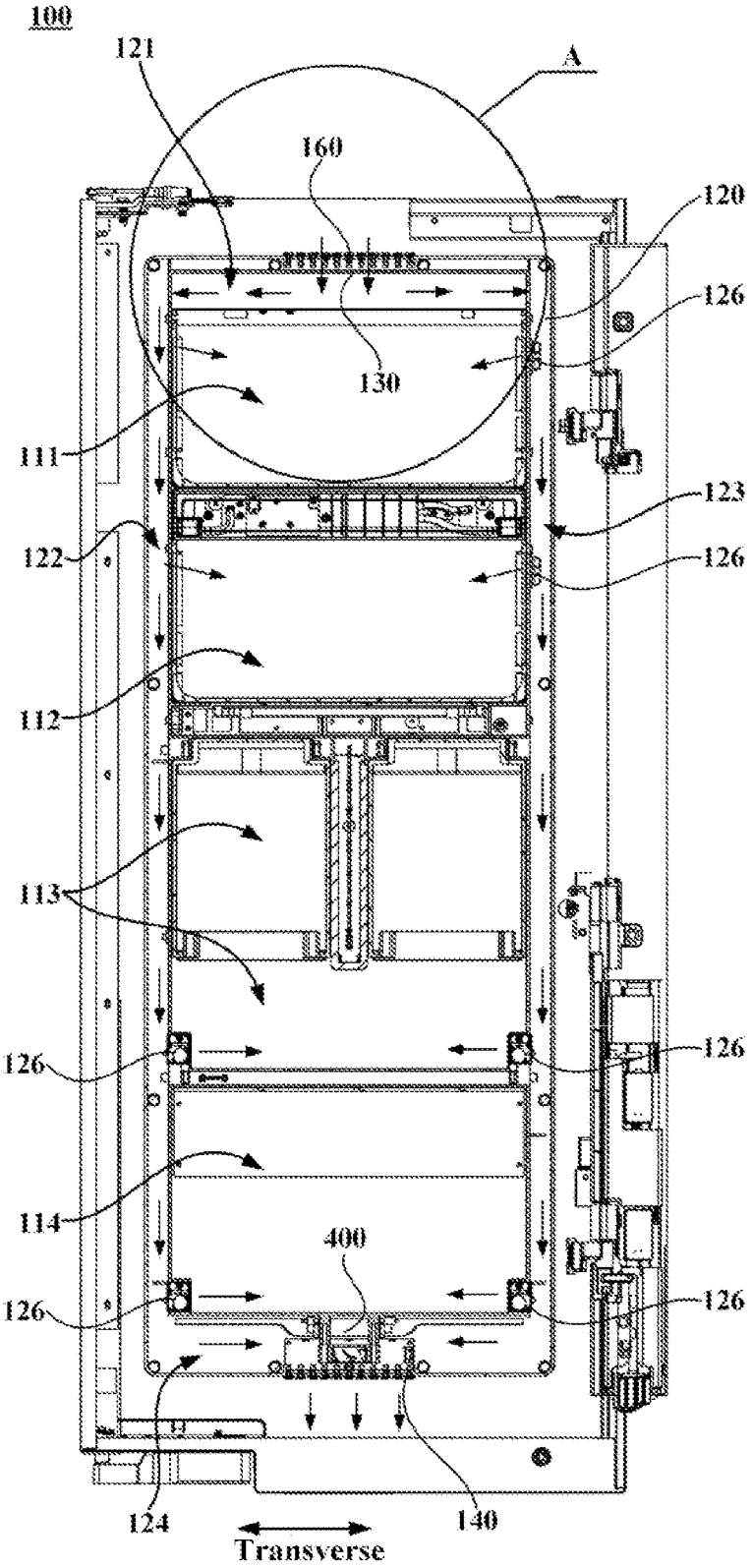
FIG. 4 is an N-N sectional schematic diagram of a main door in FIG. 3.
Figure 5:
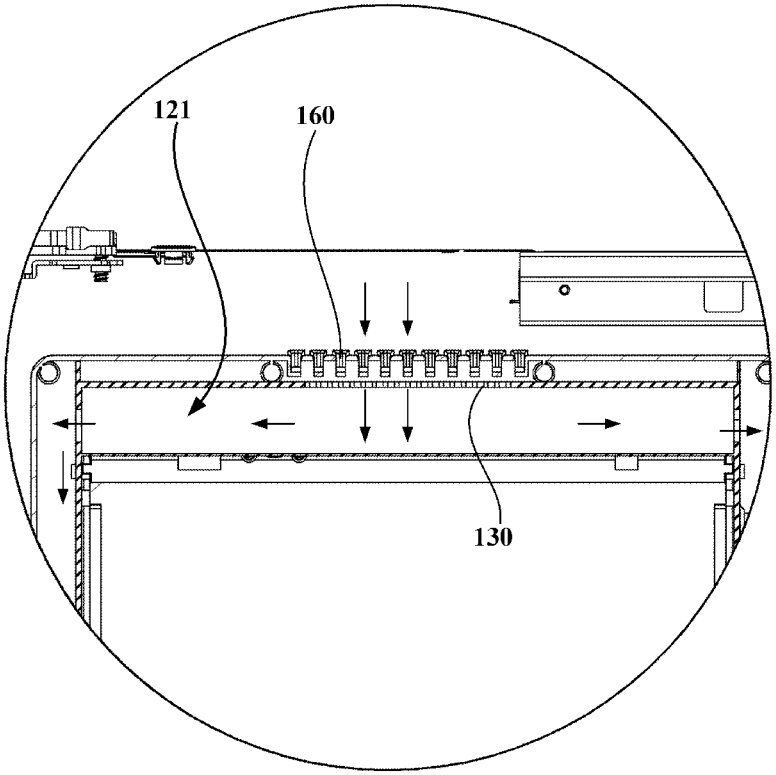
FIG. 5 is an enlarged view at A of FIG. 4.

FIG. 1 is a principle schematic diagram of a refrigerator according to an embodiment of the present invention; FIG. 2 is another principle schematic diagram of a refrigerator according to an embodiment of the present invention; FIG. 3 is a schematic diagram of a structure of a door body 20 in a refrigerator according to an embodiment of the present invention; FIG. 4 is an N-N sectional schematic diagram of a main door 100 in FIG. 3; and FIG. 5 is an enlarged view at A of FIG. 4.

As shown in FIGS. 1 to 5, the refrigerator according to the embodiment of the present invention may generally include a refrigerator body 10 and a door body 20. A front side (the side where the door body 20 is located is used as the front side of the refrigerator provided by the present invention, and the front and rear directions have been shown in the figures) of the refrigerator body 10 is open to define a first chamber 11. The door body 20 is used for opening and closing the first chamber 11, and a second chamber 110 is defined by the door body 20. The first chamber 11 and the second chamber 110 are both used for storage.

As shown in FIG. 4, the door body 20 further defines a square annular air duct 120 surrounding an outer side of the second chamber 110. The air duct 120 includes an air inlet section 121, two air supply sections 122, 123 and an air outlet section 124 which are respectively located at an upper side, two transverse sides and a lower side of the second chamber 110. The air inlet section 121, the two air supply sections 122, 123 and the air outlet section 124 are only names for all sections of the square annular air duct 120, and the air duct 120 is completely through on the whole.

In all the sections of the air duct 120, the air inlet section has an air inlet 130 for intake of cold air, each of the air supply sections 122, 123 has an air supply portion 126 for conveying the cold air to the second chamber 110, and the air outlet section 124 has an air outlet 140 for discharging the remaining cold air in the air duct 120. When the refrigerator is running, the cold air outside the second chamber 110 enters the air inlet section 121 of the air duct 120 through the air inlet 130, and then flows from the air inlet section 121 in two ways to the left and right respectively so as to enter the two air supply sections 122, 123. The air supply portions 126 on the air supply sections 122, 123 can be controlled to open to introduce part of the cold air into the second chamber 110 so as to cool the second chamber 110, and the remaining air flow that does not enter the air supply portions 126 continues to flow downward into the air outlet section 124 and finally flows out of the air duct 120 through the air outlet section 124. In this way, the air duct 120 completes the supply of cold air to the second chamber 110, and fresh cold air continuously enters the air duct 120 from the air inlet 130 and flows to the air supply sections 122, 123, so as to be ready to be supplied to the second chamber 110 at any time, so that the cold air entering the second chamber 110 is fresher and has a lower temperature.

Figure 7:
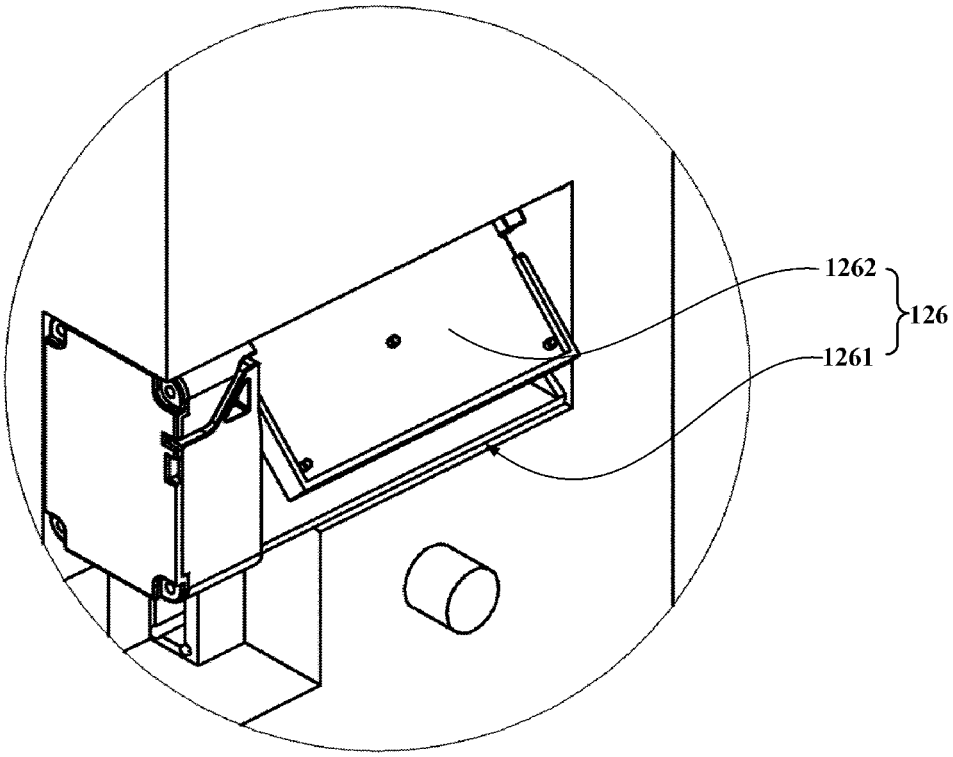
FIG. 7 is an enlarged view at B of FIG. 6.

Each of the air supply portions 126 may be allowed to include an electric damper 1262 so as to adjust the flow rate of the cold air entering the second chamber 110 from the air supply sections 122, 123. As shown in FIG. 7, the air supply sections 122, 123 are provided with ventilation openings 1261 leading to the second chamber 110, and the electric damper 1262 is disposed at the ventilation openings 1261 and is controlled by a main control panel of the refrigerator to adjust the ventilation volume of the ventilation openings 1261 in a controlled manner (including closing the ventilation openings 1261).

In some existing structures, a plurality of ventilation openings are directly reserved on a rear wall of a door body, so that a chamber defined by the door body is directly communicated with a chamber defined by a refrigerator body, the cold air circulates freely, and the chamber of the refrigerator body is used to supply cold air to the chamber of the door body. However, in this way, the storage environment of the chamber of the door body is not much different from that of the chamber of the refrigerator body, so that the existence of the chamber of the door body is of little significance.

In the embodiment of the present invention, the second chamber 110 defined by the door body 20 is not simply and directly communicated with the first chamber 11 defined by the refrigerator body 10, but is specially designed with the air duct 120 for cooling the second chamber 110. Therefore, the refrigerator can adjust the cryogenic temperature of the second chamber 110 by adjusting the supply of cold air from the air duct 120 to the second chamber 110, thus making the second chamber truly an independent storage space independent of the first chamber 11, enriching users' choices and improving the user experience.

Furthermore, the air duct 120 is in a square ring shape surrounding the outer side of the second chamber 110, and the air supply sections 122, 123, located at the two transverse sides of the second chamber 110, of the air duct 120 are used to supply air to the second chamber 110. Since the air supply sections 122, 123 span the entire height range of the second chamber 110, a designer can choose to dispose a plurality of air supply portions 126 at multiple height positions of the air supply sections 122, 123 to meet the cold air demand at various height positions of the second chamber 110, and the temperature distribution throughout the second chamber 110 is accordingly more uniform. Moreover, the cold air of each air supply portion 126 comes directly from the air duct 120, so that the coverage of the air supply portions 126 is directly cooled by the cold air of the air duct 120, and the refrigeration efficiency is thus higher.

For example, as shown in FIGS. 2 and 3, the second chamber 110 may be divided into a plurality of sub-chambers 111, 112, 113, 114, and each of the sub-chambers 111, 112, 113, 114 is matched with at least one of the air supply portions 126. For example, as shown in FIGS. 3 and 4, the four sub-chambers 111, 112, 113, 114 can be provided, and storage modules such as storage boxes, drawers, and shelves may be disposed in the sub-chambers 111, 112, 113, 114. Each sub-chamber may be matched with the air supply portions 126 on the two air supply sections 122, 123. That is to say, there are one or more air intake points on both transverse sides of each sub-chamber, so as to give full play to the advantage of the air duct 120 having the two air supply sections 122, 123, so that the cold air supplied to the two transverse sides of the sub-chamber is allowed to be more equalized.

In the embodiment of the present invention, the second chamber 110 is provided with the plurality of sub-chambers 111, 112, 113, 114, and each of the sub-chambers is matched with the independent air supply portions, so that each sub-chamber is independently supplied with the cold air, and the temperatures of all the sub-chambers can be independently adjusted to form storage environments which are different from each other. A user can individually adjust the temperature of each sub-chamber according to the special requirement for the temperature of articles stored in the sub-chamber, so that a best storage state can be achieved.

In some embodiments, the door body 20 is configured to make both the air inlet 130 and the air outlet 140 located in the first chamber 11 when the door body is in a closed state, so as to allow the air duct 120 to introduce the cold air in the first chamber 11 and return air to the first chamber 11. In some alternative embodiments, the air inlet 130 of the air duct 120 may also introduce cold air from other cold sources, for example, the air inlet is connected to an air path of the refrigerator body 10 to directly introduce the cold air from an evaporator room of the refrigerator. This alternative method will not be repeated here.

The refrigerator can be refrigerated by a vapor compression refrigeration cycle system, a semiconductor refrigeration system or other means. According to different refrigeration temperatures, all chambers inside the refrigerator can be divided into a refrigerating room, a freezing room and a temperature-variable room. For example, the temperature in the refrigerating room is generally controlled within a range of 2° C. to 10° C., preferably 4° C. to 7° C. The temperature range in the freezing room is generally controlled at −22° C. to −14° C. The temperature-variable room can be adjusted within a temperature range of −18° C. to 8° C. to achieve a variable temperature effect. Different types of articles are different in optimal storage temperatures and storage chambers suitable for storage. For example, fruit and vegetable foods are suitable for storage in the refrigerating room, and meat foods are suitable for storage in the freezing room. The first chamber 11 in the embodiment of the present invention is preferably a refrigerating room.

A bottom of the second chamber 110 may be provided with an air return inlet 190. When the door body 20 is in the closed state, the air return inlet 190 is located in the first chamber 11 to allow the second chamber 110 to return air to the first chamber 11. After entering the first chamber 11, a return air flow flows from bottom to top due to its higher temperature and lower density, and is gradually cooled again by the cold air of the first chamber 11 in the flowing process.

In some embodiments, an exhaust fan 400 is disposed at a transverse central position of the air outlet section 124 to exhaust air to the air outlet 140, so as to promote the flowing of air flow in the air duct 120, as shown in FIG. 4.

In addition, an air inlet fan may be disposed in the air inlet section 121 to suck the cold air into the air duct 120 through the air inlet 130 to promote the flowing of the air flow in the air duct 120. Both the air inlet 130 and the air inlet fan are located at a transverse central position of the air inlet section 121, so that the air inlet fan blows uniformly to both transverse sides of the air inlet section 121.

Figure 6:
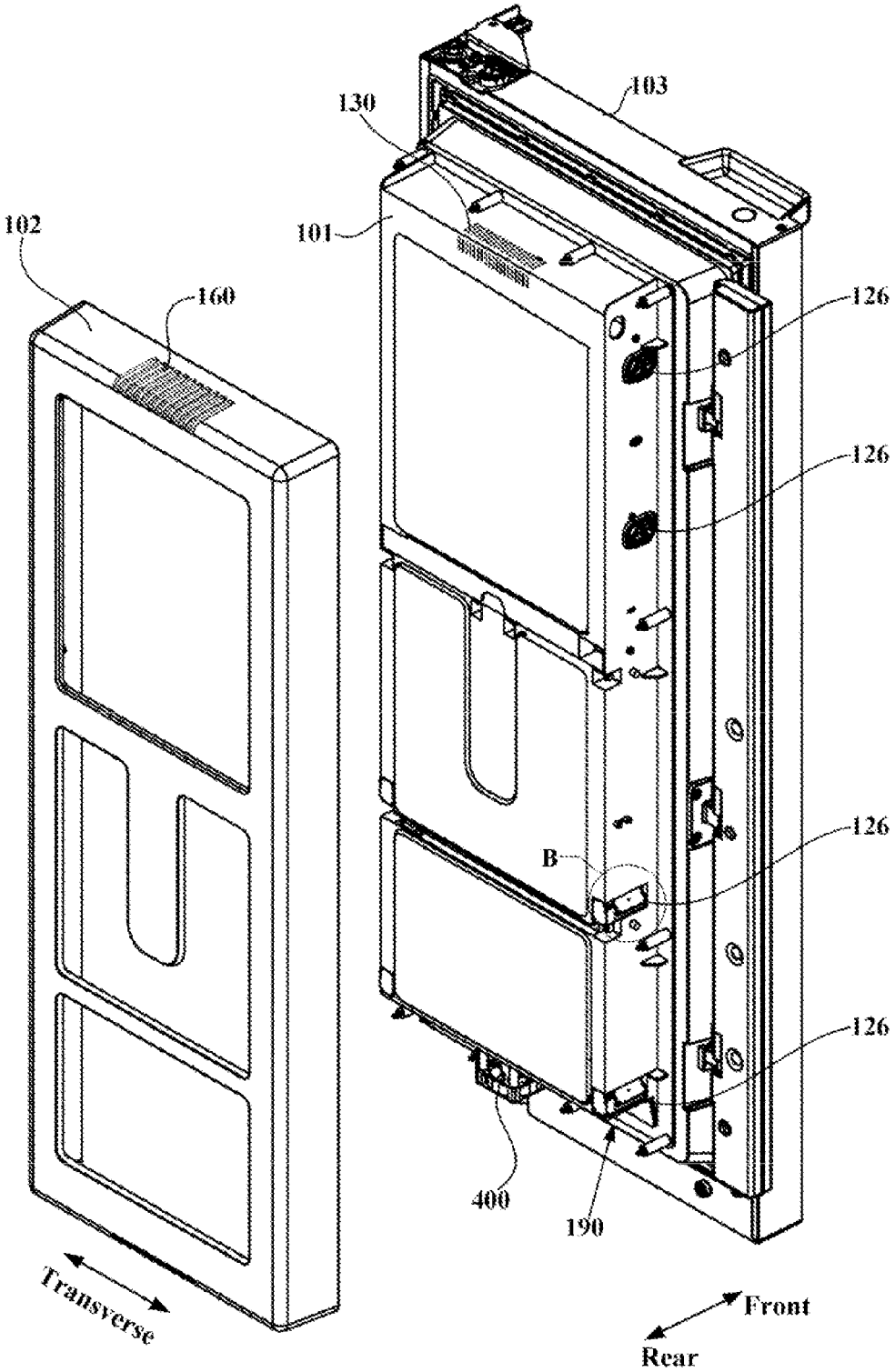
FIG. 6 is an exploded schematic view of the main door in FIG. 3.

FIG. 6 is an exploded schematic view of the main door 100 in FIG. 3.

In some embodiments, as shown in FIG. 6, the door body 20 includes an inner liner 101 and an enclosure cover 102. The inner liner 101 defines the second chamber 110 and the air inlet section 121. The door body 20 may further include an outer frame 103, and the inner liner 101 is installed in the outer frame 103. The enclosure cover 102 surrounds and covers the inner liner 101 at a circumferential outer side of the inner liner 101, so as to define the two air supply sections 122, 123 and the air outlet section 124 together with an outer wall of the inner liner 101. A top of the enclosure cover 102 is provided with an air inlet grille 160 opposite to the air inlet 130, and the air outlet 140 is provided at a bottom thereof. In the embodiment, the air duct 120 is formed by the enclosure cover 102 covering the outer side of the inner liner 101, so that the structure is very simple and practical.

In some embodiments, as shown in FIGS. 1 to 3, the refrigerator is a refrigerator with a composite door. The door body 20 includes a main door 100 and a secondary door 200, where the main door 100 is used for defining the second chamber 110 and the air duct 120, and the secondary door 200 is used for opening and closing the second chamber 110. The main door 100 can be rotatably installed on the refrigerator body 10 at the front side of the refrigerator body 10, a front side of the main door 100 is open to define the aforementioned second chamber 110, and the secondary door 200 can be rotatably installed on the main door 100 at the front side of the main door 100. When the main door 100 is opened, a user accesses articles from the first chamber 11. When the main door 100 is closed and the secondary door 200 is opened, the user can access articles from the second chamber 110.

Hereto, those skilled in the art should realize that although a plurality of exemplary embodiments of the present invention have been shown and described in detail herein, without departing from the spirit and scope of the present invention, many other variations or modifications that conform to the principles of the present invention can still be directly determined or deduced from the contents disclosed in the present invention. Therefore, the scope of the present invention should be understood and recognized as covering all these other variations or modifications.

What is claimed is:

1. A refrigerator, comprising:

a refrigerator body, a front side of which is open to define a first chamber; and a door body, used for opening and closing the first chamber and defining a second chamber, wherein the door body further defines a square annular air duct surrounding an outer side of the second chamber, and the square annular air duct comprises an air inlet section, two air supply sections and an air outlet section which are respectively located at an upper side, two transverse sides and a lower side of the second chamber; and the air inlet section has an air inlet for intake of cold air, each air supply section has one or more air supply portions for conveying the cold air to the second chamber, and the air outlet section has an air outlet for discharging the remaining cold air from the square annular air duct without the remaining cold air entering the second chamber;

wherein the door body comprises:

an inner liner, defining the second chamber and the air inlet section; and an enclosure cover, which surrounds and covers the inner liner at a circumferential outer side of the inner liner, so that the two air supply sections and the air outlet section are defined between an outer wall of the inner liner and the enclosure cover; and a top of the enclosure cover is provided with an air inlet grille opposite to the air inlet, and the air outlet is provided at a bottom wall of the enclosure cover;

wherein the door body is configured such that both the air inlet and the air outlet are located in the first chamber when the door body is in a closed state, so as to allow the square annular air duct to introduce the cold air from the first chamber and return air to the first chamber.

2. The refrigerator according to claim 1, wherein the second chamber is divided into a plurality of sub-chambers, and each of the sub-chambers is matched with at least one of the one or more air supply portions.

3. The refrigerator according to claim 2, wherein each of the sub-chambers is matched with the air supply portions on the two air supply sections.

4. The refrigerator according to claim 1, wherein each of the air supply portions comprises an electric damper so as to adjust a flow rate of cold air entering the second chamber from the air supply sections.

5. The refrigerator according to claim 1, wherein an air return inlet is reserved in a bottom wall of the second chamber; and when the door body is in a closed state, the air return inlet is located in the first chamber to allow the second chamber to return air to the first chamber.

6. The refrigerator according to claim 1, wherein the air inlet is located at a transverse central position of the air inlet section.

7. The refrigerator according to claim 1, wherein an exhaust fan is disposed at a transverse central position of the air outlet section, so as to exhaust air to the air outlet.

8. The refrigerator according to claim 1, wherein the door body comprises a main door and a secondary door, wherein the main door is used for defining the second chamber and the square annular air duct, and the secondary door is used for opening and closing the second chamber.

* * * * *